US011118398B2

(12) United States Patent
Kaiser et al.

(10) Patent No.: US 11,118,398 B2
(45) Date of Patent: Sep. 14, 2021

(54) GATE ASSEMBLY AND KIT

(71) Applicant: Kidco, Inc., Libertyville, IL (US)

(72) Inventors: Daniel Kaiser, Chicago, IL (US); Zhe Shen, Palatine, IL (US)

(73) Assignee: Kidco, Inc., Libertyville, IL (US)

( * ) Notice: Subject to any disclaimer, the term of this patent is extended or adjusted under 35 U.S.C. 154(b) by 132 days.

(21) Appl. No.: 16/430,986

(22) Filed: Jun. 4, 2019

(65) Prior Publication Data

US 2020/0386049 A1 Dec. 10, 2020

(51) Int. Cl.

| | |
|---|---|
| ***E06B 11/02*** | (2006.01) |
| ***E06B 9/04*** | (2006.01) |
| ***E05B 65/00*** | (2006.01) |
| *E06B 9/00* | (2006.01) |

(52) U.S. Cl.

CPC ..... *E06B 11/022* (2013.01); *E05B 65/0007* (2013.01); *E06B 9/04* (2013.01); *E06B 2009/002* (2013.01)

(58) Field of Classification Search

CPC ..... E06B 9/04; E06B 9/06; E06B 2009/002; E05B 65/0007

See application file for complete search history.

(56) References Cited

U.S. PATENT DOCUMENTS

| | | | | |
|---|---|---|---|---|
| 9,982,479 | B1 * | 5/2018 | Flannery | E06B 9/02 |
| 10,024,080 | B2 * | 7/2018 | Marsden | E05B 41/00 |
| 2009/0013606 | A1 * | 1/2009 | Yates | E06B 9/04 49/463 |
| 2009/0293363 | A1 * | 12/2009 | Flannery | E06B 9/04 49/55 |
| 2011/0289852 | A1 * | 12/2011 | Dunn | B65D 85/64 49/460 |
| 2014/0190641 | A1 * | 7/2014 | Wang | E06B 9/06 160/222 |
| 2015/0089873 | A1 * | 4/2015 | Marsden | E06B 9/02 49/56 |
| 2017/0058595 | A1 * | 3/2017 | Marsden | E05B 65/0007 |
| 2017/0211314 | A1 * | 7/2017 | Raffi | E06B 9/04 |
| 2019/0003250 | A1 * | 1/2019 | Flannery | E06B 11/02 |
| 2019/0136619 | A1 * | 5/2019 | Flannery | E06B 11/04 |
| 2019/0194977 | A1 * | 6/2019 | Sander | E05B 65/0888 |
| 2020/0340295 | A1 * | 10/2020 | Wang | E06B 9/04 |

* cited by examiner

*Primary Examiner* — Marcus Menezes
(74) *Attorney, Agent, or Firm* — Quarles & Brady LLP

(57) ABSTRACT

A kit for a baby gate assembly, comprising a first panel that includes a first upper rail, a first lower rail, and a plurality of first posts, and a second panel that includes a second upper rail, a second lower rail, and a plurality of second posts. The kit further includes a plurality of spindle assemblies and a plurality of latch assemblies. Components comprising the first panel, the second panel, the plurality of spindle assemblies, and the plurality of latch assemblies are capable of being shipped in a package. The first panel defines a plurality of panel dimensions. Components comprising the first panel, the second panel, the plurality of spindle assemblies, and the plurality of latch assemblies are contained in a package that defines a plurality of packaging dimensions. At least one of the plurality of packaging dimensions is smaller than at least one of the corresponding panel dimensions.

17 Claims, 13 Drawing Sheets

GATE ASSEMBLY AND KIT

BACKGROUND

Field of the Disclosure

The present disclosure relates to a gate assembly such as a baby gate, and a kit for transport thereof.

Description of the Background of the Disclosure

In the field of baby or safety gates, adjustable gates are configured to fit within a conventional door frame as a popular and effective means of preventing children or pets from entering certain areas. Such areas may contain, for example, potentially hazardous or breakable items that parents and/or homeowners desire to restrict from children or pet interaction. Baby gates are typically constructed of metal, plastic, and/or wood, and can be expanded to fit in a range of doorway widths. They may be designed for use indoors or outdoors, and may be either hardware or pressure-mounted. Such gates are also frequently used to contain small pets.

Pressure-mounted gates are typically held in place by friction when such gates are installed against walls on either side, while hardware-mounted gates are screwed into the wall studs and are operable to swing fully open, in a similar fashion as a door. Conventional hardware-mounted gates and mesh retractable gates can be customized to fit wide and/or irregularly shaped openings. In one class of prior art gates, closely-spaced, vertical bars are attached to a supporting structure, and the supporting structure may be adjusted to a width of the door frame. The vertical bars may be made of metal or wood, and are permanently attached to the supporting structure of the gate. For example, vertical bars made of metal may be welded to a metal support structure. Alternatively, vertical bars made of wood may be fastened to a wooden support structure before being shipped or otherwise provided to a consumer.

While welding or fastening the vertical bars to the supporting structure may result in a solidly constructed, rigid gate, the use of such unitary structures can be costly and inconvenient for both the manufacturer and the user. Since the vertical bars are thin, a plurality of vertical bars must be used to serve as a sufficient barrier to prevent children or pets from squeezing through the bars, but when skilled laborers or expensive machines are used to perform the welding or fastening procedures, a greater number of bars translates to a greater cost and time to manufacture each gate.

Therefore, what is needed is a gate that addresses one or more of the drawbacks of existing gates.

SUMMARY

In one aspect, a kit for a baby gate assembly includes a first panel that includes a first upper rail, a first lower rail, and a plurality of first posts, a second panel that includes a second upper rail, a second lower rail, and a plurality of second posts, a plurality of spindle assemblies, and a plurality of latch assemblies. The first panel defines a plurality of dimensions, and components comprising the first panel, the second panel, the plurality of spindle assemblies, and the plurality of latch assemblies are contained in a package that defines a plurality of packaging dimensions. At least one of the plurality of packaging dimensions is smaller than at least one of the corresponding panel dimensions. In some embodiments, the plurality of spindle assemblies includes an upper spindle assembly and a lower spindle assembly that is different than the upper spindle assembly. In some embodiments, the upper spindle assembly includes a post that depends from a spindle, and the lower spindle assembly includes an end nut that is capable of being inserted over a wall post.

In some embodiments, the plurality of first posts includes at least one first cylindrical post, at least one first fastening post, and at least one first crimped post. In some embodiments, the plurality of second posts includes at least one second cylindrical post, at least one second fastening post, and at least one second crimped post. In some embodiments, the at least one first fastening post is capable of being securely fastened to the first upper rail, while the at least one first cylindrical post is capable of being inserted into a post receiving aperture of the first upper rail. In some embodiments, the first upper rail and the second upper rail each include a plurality of adjustment apertures that are capable of alignment with one another. In some embodiments, the first upper rail, the first lower rail, the second upper rail, and the second lower rail each include a plurality of post receiving apertures. In some embodiments, the plurality of post receiving apertures along each of the first upper rail, the first lower rail, the second upper rail, and the second lower rail have varying diameters. In some embodiments, the plurality of spindle assemblies each include a bolt and a nut, the bolt being capable of insertion into the first upper rail and the first lower rail.

In another aspect, a method of shipping and assembling a baby gate assembly includes the steps of providing a package that has a profile that has a first packaging dimension, a second packaging dimension, and a third packaging dimension, and inserting into the package a plurality of components that include a first panel that includes a first upper rail, a first lower rail, and a plurality of first posts, a second panel that includes a second upper rail, a second lower rail, and a plurality of second posts, a plurality of spindle assemblies, and a plurality of latch assemblies. The first panel, when assembled, defines a first panel dimension, a second panel dimension, and a third panel dimension, and at least two of the first packaging dimension, the second packaging dimension, and the third packaging dimension are smaller than at least two of the first panel dimension, the second panel dimension, and the third panel dimension. In some embodiments, the method further includes the step of aligning the first panel with the second panel and inserting at least one fastener through adjustment apertures within the first upper rail and the second upper rail. In some embodiments, the method further includes the steps of inserting an upper spindle assembly into the first upper rail, and inserting a lower spindle assembly into the first lower rail.

In some embodiments, the plurality of spindle assemblies includes an upper spindle assembly and a lower spindle assembly that is different than the upper spindle assembly, and the upper spindle assembly includes a post that depends from a spindle and the lower spindle assembly includes an end nut that is capable of being inserted over a wall post. In some embodiments, the plurality of second posts includes at least one second cylindrical post, at least one second fastening post, and at least one second crimped post. In some embodiments, the at least one first fastening post is capable of being securely fastened to the first upper rail, while the at least at least one first cylindrical post is capable of being inserted into a post receiving aperture of the first upper rail. In some embodiments, the first upper rail and the second upper rail each include a plurality of adjustment apertures that are capable of alignment with one another, and the method further includes the step of aligning the plurality of adjustment apertures along the first upper rail and the plurality of adjustment apertures along the second upper rail.

In some embodiments, the first upper rail, the first lower rail, the second upper rail, and the second lower rail each include a plurality of post receiving apertures. In some embodiments, the method further includes the steps of inserting at least some of the first posts into the plurality of post receiving apertures along the first upper rail or the first lower rail, and inserting at least some of the second posts into the plurality of post receiving apertures along the second upper rail or the second lower rail. In some embodiments, the plurality of spindle assemblies each include a bolt and a nut, the bolt being capable of insertion into the first upper rail and the first lower rail.

DETAILED DESCRIPTION

The following discussion and accompanying figures disclose various embodiments or configurations of a knock down gate and kit for assembly thereof that is capable of being secured between two static structures, such as walls, or within a doorway. Although embodiments of a knock down gate assembly are disclosed that are specific to hardware-based securement of the gate, concepts associated with embodiments of the assembly may be implemented with a wide variety of baby gate assemblies, including doorway-based gates, banister gates including baby gates intended to be used at the top or bottom of stairwells, swing-open gates, pressure-fit gates, hardware-retaining gates, lockable gates, or any other type of gate that prevents ingress or egress of a baby, toddler, or pet from one room to another. Accordingly, concepts described herein may be utilized in a variety of products and in a variety of applications.

The term "about," as used herein, refers to variations in the numerical quantity that may occur, for example, through typical measuring and manufacturing procedures used for knock down gate assembly manufacturing, or other articles of manufacture that may include embodiments of the disclosure herein, through inadvertent error in these procedures, through differences in the manufacture, source, or purity of the ingredients used to make the compositions or mixtures or carry out the methods, and the like. Throughout the disclosure, the terms "about" and "approximately" refer to a range of values ±5% of the numeric value that the term precedes.

Figure 1:
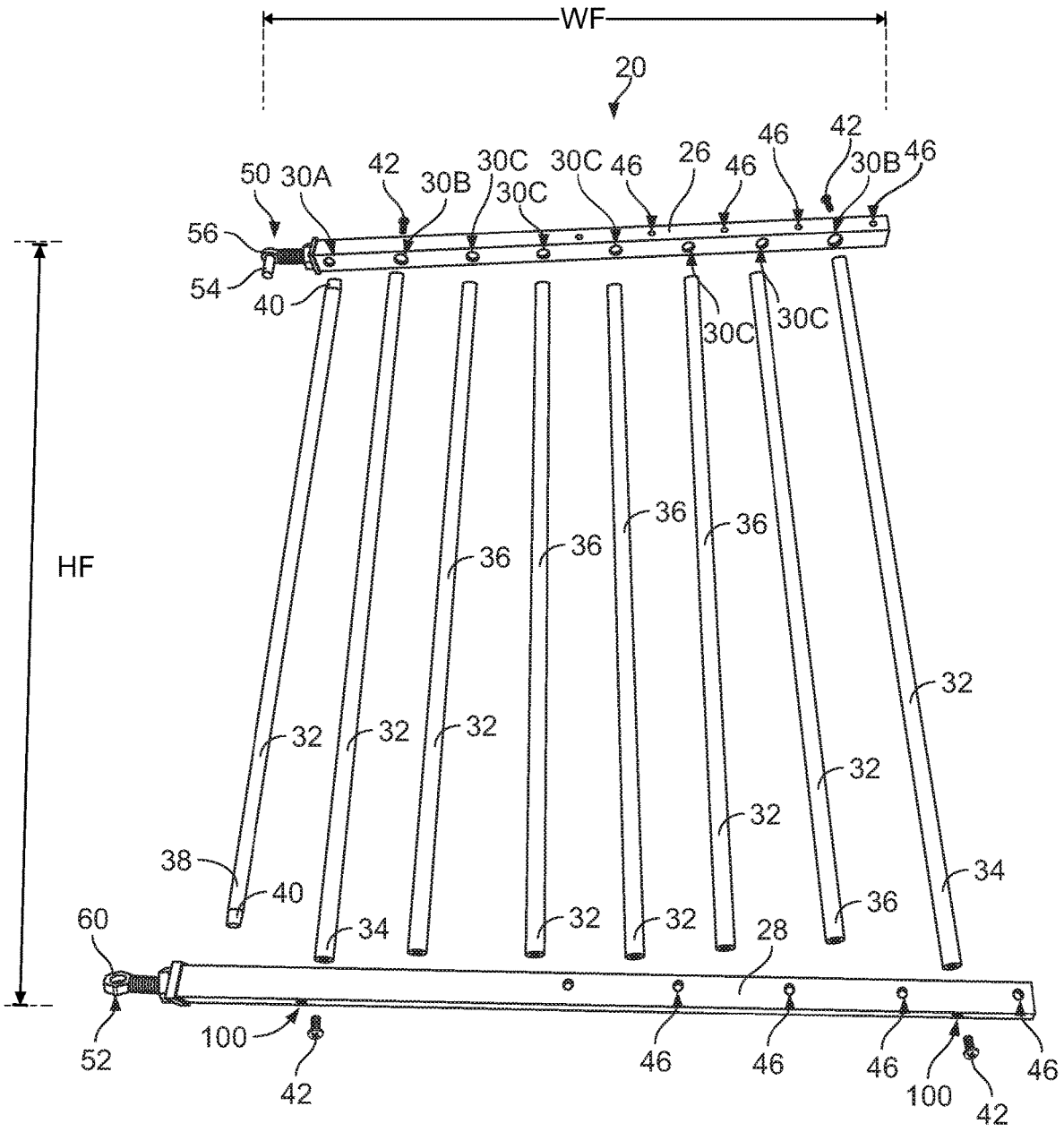
FIG. 1 is a front, isometric view of a first portion of a baby gate assembly that is shown in a disassembled state.
Figure 2:
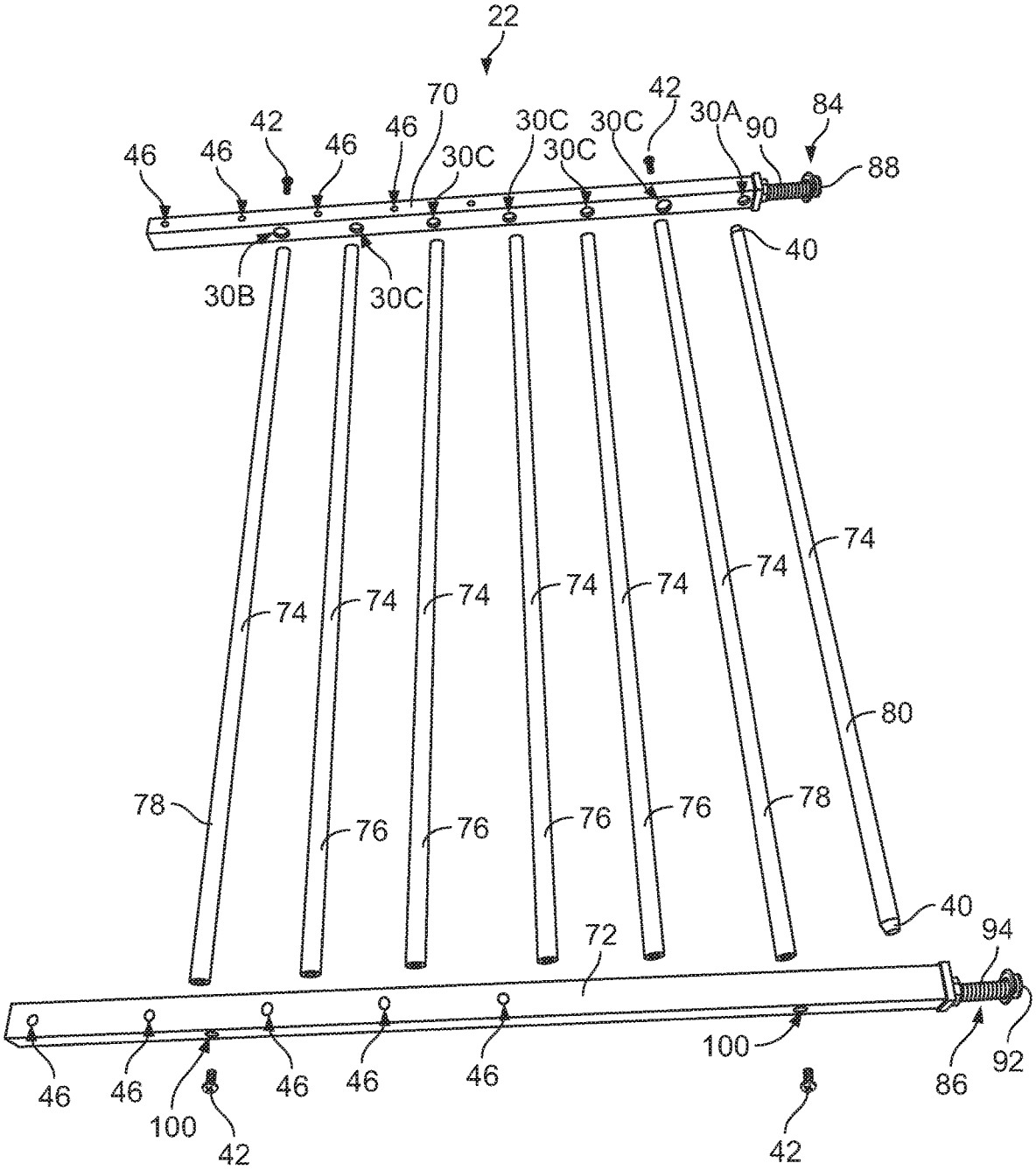
FIG. 2 is a front, isometric view of a second portion of the baby gate assembly of FIG. 1 in a disassembled state.

Referring to FIGS. 1 and 2, a first panel 20 and a second panel 22 of a knock down gate assembly 24 (see FIG. 3) are shown in disassembled states, respectively. Referring specifically to FIG. 1, the first panel 20 is shown in detail. The first panel 20 comprises a first upper rail 26 and a first lower rail 28. The first upper rail 26 and the first lower rail 28 are disposed at opposing ends of the first panel 20, and each includes a plurality of post receiving apertures 30. The post receiving apertures 30 are sized and shaped to receive ends of a plurality of first posts 32, which are generally disposed orthogonally with respect to the first upper rail 26 and the first lower rail 28. The plurality of first posts 32 may comprise a plurality of first fastening posts 34, a plurality of first cylindrical posts 36, and a first crimped post 38.

Referring to the specific orientation shown in FIG. 1, the first crimped post 38 is disposed at a far left side of the first panel 20, and includes crimped portions 40 at its upper and lower ends. The first crimped post 38 aids in assembly of the gate assembly 24, as discussed in greater detail hereinafter below. The first crimped post 38 is inserted into post receiving apertures 30A that are smaller in diameter than the post receiving apertures 30 that receive the first cylindrical posts 36. The first fastening posts 34 are inserted into post receiving apertures 30B that are larger in diameter than the post receiving apertures 30C that receive the first cylindrical posts 36.

Still referring to FIG. 1, a plurality of post fasteners 42 are shown, which may be bolts, screws, or other fasteners known to those of ordinary skill in the art. The post fasteners 42 may be inserted into the first upper rail 26 and the first lower rail 28, and engage with the first fastening posts 34. In the present embodiment, the post fasteners 42 engage with the first fastening posts 34, which are disposed on the left side and the right side of the first panel 20. The five first cylindrical posts 36 are not fastened to the rails 26, 28; rather, upper and lower ends of the first cylindrical posts 36 are retained within the post receiving apertures 30 when the rails 26, 28 are fastened to the first fastening posts 34. In alternative embodiments, more or all of the first cylindrical posts 36 are constructed as first fastening posts 34, and are rigidly fastened to the first rails 26, 28 via the post fasteners 42, adhesive, or another means of fastening.

The first fastening posts 34 are larger in diameter than both the first cylindrical posts 36 and the first crimped post 38. The first cylindrical posts 36 are larger in diameter than the first crimped post 38. As a result, the sizes of the post receiving apertures 30 vary to snugly or fittingly receive whichever of the posts 34, 36, 38 is being inserted into each post receiving aperture 30. While the diameters of the posts 34, 36, 38 are varied in the present embodiment, it is contemplated that alternative diameters of the posts 34, 36, 38 may be practiced. Further, alternative post configurations are also contemplated, and the posts 34, 36, 38 may have other, non-circular cross sections or cross-sections that vary in diameter along a length of the posts 34, 36, 38. In some embodiments, one or more of the posts 34, 36, 38 may have a wave-like pattern along a length thereof.

As further illustrated in FIG. 1, a plurality of horizontal adjustment apertures 46 are provided along the first upper rail 26 and the first lower rail 28, which allow for width adjustment of the assembly 24 when assembled and installed. Pins, screws, bolts, or other types of adjustment fasteners 48 (see FIG. 6) may be inserted into one or more of the horizontal adjustment apertures 46 and may be retained within a corresponding adjustment aperture 46 along the second panel 22 (see FIG. 2). The first crimped post 38, which is disposed along a far left side of the first panel 20, may be shorter than the first fastening posts 34 and/or the first cylindrical posts 36, allowing hardware to be inserted into the horizontal top and bottom rails 26, 28 into the spaces in-line with the first crimped post 38. The plurality of first fastening posts 34 are wider in diameter than both the crimped post 38 and the plurality of first cylindrical posts 36, and may be formed with internal threading to allow the fasteners 42 to engage with the first fastening posts 34, which thereby retains the fastening posts 34 with the rails 26, 28. In one aspect, the internal threading may be formed directly on an internal surface of the first fastening posts 34. Alternatively, in another aspect, the internal threading may be achieved by welding, adhering, or otherwise coupling a threaded nut into one or both of the upper and lower ends of the first fastening posts 34. The cylindrical posts 36 that are disposed between the fastening posts 34 are placed inside of the frame and "sandwiched" by the first rails 26, 28. The first panel 20 is preferably disposed in an orientation similar to that shown in FIG. 1 immediately before fastening and assembling the various components.

Still referring to FIG. 1, the first panel 20 further includes a first or upper spindle assembly 50 and a second or lower spindle assembly 52. The upper spindle assembly 50 includes a pin 54 that depends downward from a top spindle 56, which is received by a hinge 58 (see FIG. 7), which is fixedly attached to a wall. The lower spindle assembly 52 includes a hinge spindle 60 that is received by a wall post 62 (see FIG. 10), which is also fixedly attached to a wall (see FIG. 10). The wall post 62 is connected with a lower hinge bracket 64, which is fixedly attached to the wall. The first spindle assembly 50 and the second spindle assembly 52 allow the gate assembly 24 to hingedly rotate when opened or closed by a user. Alternative configurations of the spindle assemblies 50, 52 are contemplated. For example, both the upper rail 26 and the lower rail 28 may be coupled with the first spindle assembly 50, or both the upper rail 26 and the lower rail 28 may be coupled with the second spindle assembly 52. Alternative spindle assemblies may also be utilized, depending on the desired functionality of the gate assembly 24.

Referring now to FIG. 2, the second panel 22 is shown, which includes a similar structure as the first panel 20, however, it includes one fewer cylindrical post. The second panel 22 comprises a second upper rail 70 and a second lower rail 72. The second upper rail 70 and the second lower rail 72 are disposed at opposing top and bottom ends of the gate assembly 24, and each includes a plurality of post receiving apertures 30. The post receiving apertures 30 are sized and shaped to receive ends of a plurality of second posts 74, which are generally disposed orthogonally with respect to the second upper rail 70 and the second lower rail 72. The plurality of second posts 74 comprise a plurality of second cylindrical posts 76, a plurality of second fastening posts 78, and a second crimped post 80. Referring to the orientation of FIG. 2, the second crimped post 80 is disposed at a far right side of the second panel 22, and includes crimped portions 40 at its upper and lower ends. The crimped post 80 aids in assembly of the gate assembly 24, as discussed in greater detail hereinafter below.

Still referring to FIG. 2, a plurality of post fasteners 42 are shown, which may be bolts, screws, or other fasteners known to those of ordinary skill in the art. As with the first panel 20, the fasteners 42 may be inserted into the second upper rail 70 and the second lower rail 72 of the second panel 22, and engage with the second fastening posts 74. In the present embodiment, the fasteners 42 engage with the fastening posts 78 on the left side and the right side of the second panel 22. As further shown in FIG. 2, a plurality of adjustment apertures 46 are provided along the second upper rail 70 and the second lower rail 72, which allow for width adjustment of the assembly 24 when assembled and installed. The adjustment apertures 46 along the first upper rail 26 and the second upper rail 70 are configured to align with one another when the adjustment apertures 46 along the first lower rail 28 and the second lower rail 72 also align with one another. Pins or other types of fasteners may be inserted into one or more of the adjustment apertures 46.

Figure 4:
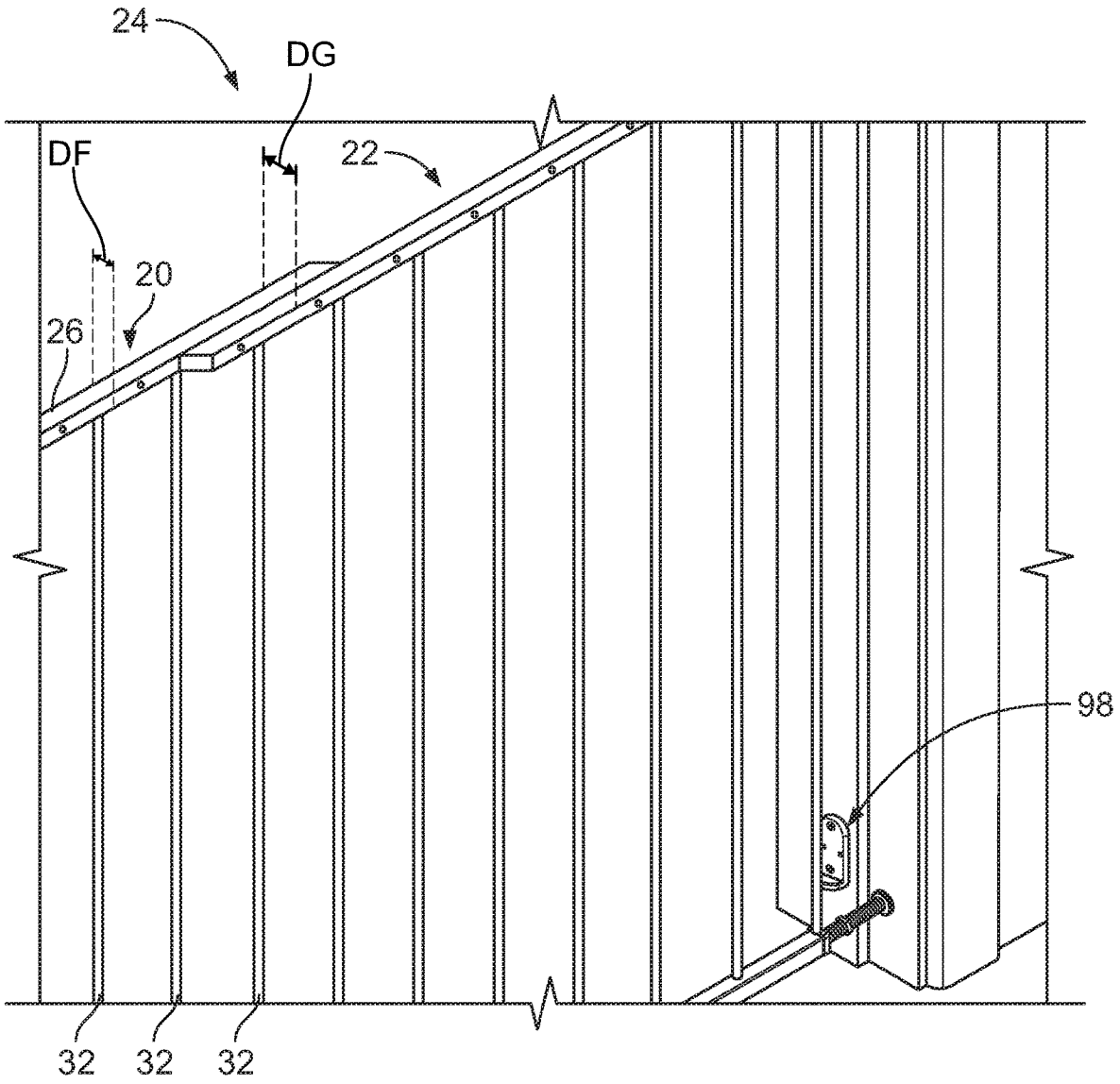
FIG. 4 is a perspective view of the baby gate assembly of FIG. 3 highlighting an adjustable spindle assembly at a corner of the baby gate assembly before installation.
Figure 9:
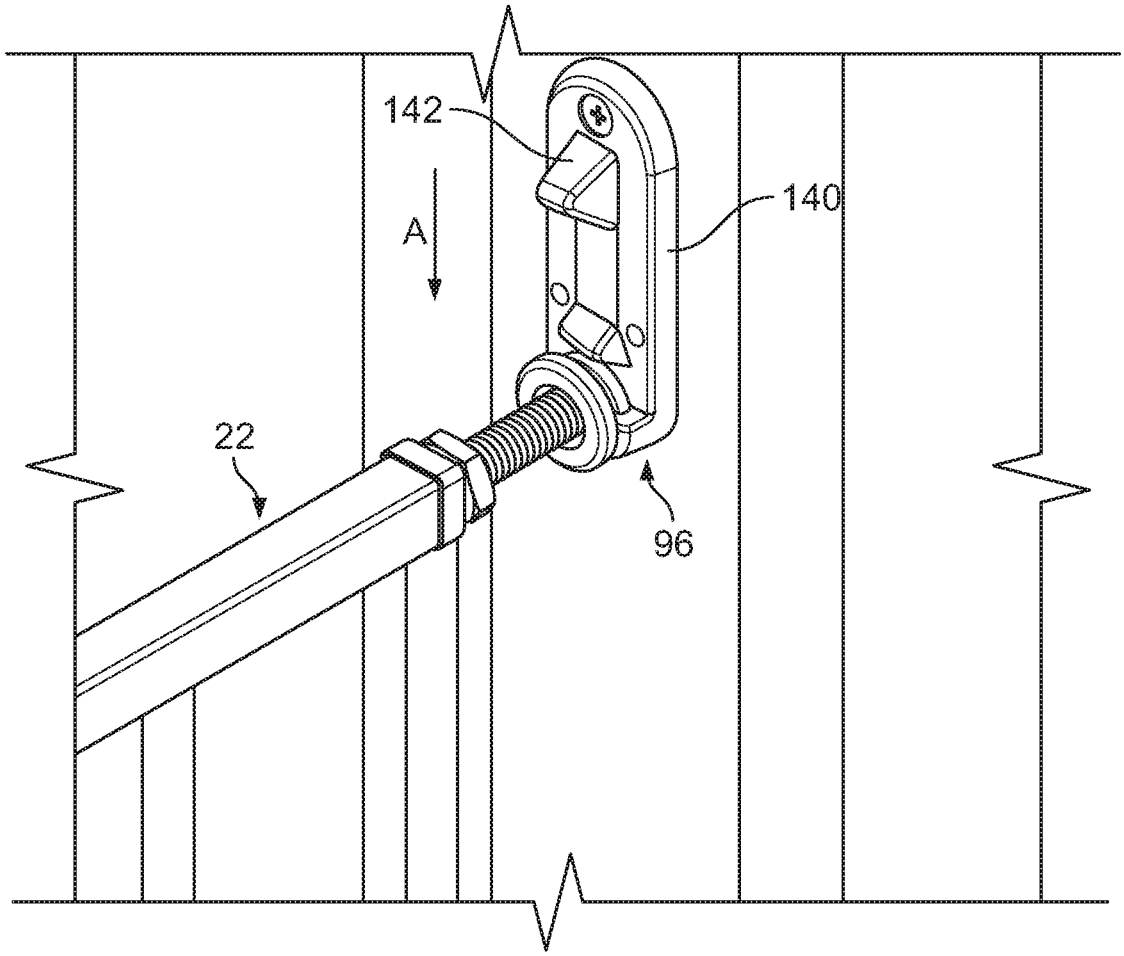
FIG. 9 is a perspective view of a latch spindle being inserted into a latch bracket.

An upper spindle latch assembly 84 and a lower spindle latch assembly 86 are also shown in FIG. 2. The upper spindle latch assembly 84 includes an upper latch portion 88 and a threaded portion 90, and the lower spindle latch assembly 86 includes a lower latch portion 92 and a threaded portion 94. The latch assemblies 84, 86 are configured to latch the gate assembly 24 in a secure configuration, i.e., when the gate assembly 24 is in use. As illustrated in FIGS. 4 and 9, the upper and lower spindle latch assemblies 84, 86 are engaged with corresponding latch brackets 96, 98, which are fixedly secured to a wall or other solid structure. The spindle latch assemblies 84, 86 are removably secured with the latch brackets 96, 98 such that a user may unlatch the spindle latch assemblies 84, 86 to open the baby gate assembly 24.

Referring again to FIG. 2, the second crimped post 80, which is disposed along a far right side of the second panel 22, allows the hardware to be inserted into the second upper rail 70 and the second lower rail 72 into the spaces in-line with the second crimped post 38. In a similar fashion as the first panel 20 described above, the plurality of second fastening posts 78 are wider in diameter than the cylindrical posts 76 and the crimped post 80, and may be formed with internal threading to allow the fasteners 42 to engage with the second fastening posts 78, which thereby retains the posts 78 within the second rails 70, 72. In one aspect, the internal threading may be formed directly on an internal surface of the first fastening posts 34. Alternatively, in another aspect, the internal threading may be achieved by welding, adhering, or otherwise coupling a threaded nut into one or both of the upper and lower ends of the second fastening posts 78. The remaining second cylindrical posts 76 that are disposed between the second fastening posts 78 are all placed inside of the frame defined by the second rails 70, 72 and are "sandwiched" in by the second rails 70, 72. As noted above, the second panel 22 only includes seven of the second posts 74, while the first panel includes eight of the first posts 32. However, alternative numbers of posts may be included in either or both of the rails.

The second fastening posts 78 are larger in diameter than both the second cylindrical posts 76 and the second crimped post 80. The second cylindrical posts 76 are larger in diameter than the second crimped post 80. As a result, the sizes of the post receiving apertures 30 vary to snugly or fittingly receive whichever of the posts 76, 78, 80 is being inserted into each post receiving aperture 30. While the diameters of the posts 76, 78, 80 are varied in the present embodiment, it is contemplated that alternative diameters of the posts 76, 78, 80 may be practiced. Further, alternative post configurations are also contemplated, and the posts 76, 78, 80 may have other, non-circular cross sections or cross-sections that vary in diameter along a length of the posts 76, 78, 80.

Still referring to FIGS. 1 and 2, a method of assembling the gate assembly 24 will now be described. All of the components illustrated in FIGS. 1 and 2 should be laid flat along a surface. The upper rails 26, 70 should be positioned in a parallel fashion with the respective lower rails 28, 72 such that the post apertures 30 are aligned. The fastening posts 34, 78 should be aligned within their respective post apertures 30, and the fasteners 42 may be inserted into fastener apertures 100 along the rails 24, 26, 70, 72, although the fasteners 42 preferably are not tightened at this stage in order to leave sufficient clearance to install the first and second cylindrical posts 36, 76. The first and second cylindrical posts 36, 76 are aligned with the respective post apertures 30 in a fashion similar to the configuration shown in FIGS. 1 and 2. Thereafter, the fasteners 42, which in the present embodiment are machine screws, are either inserted into the fastener apertures 100 and are tightened or already having been inserted into the fastener apparatus 100 are simply tightened. Tightening of the fasteners 42 draws the upper rails 26, 70 and the lower rails 28, 72 closer together, and retains the cylindrical posts 36, 76 within the post apertures 30. Once the second panel 22 and the first panel 20 are assembled, the panels 20, 22 are then secured together and adjusted depending on the width of the opening that the gate is intended to span, as described in greater detail below.

Figure 3:
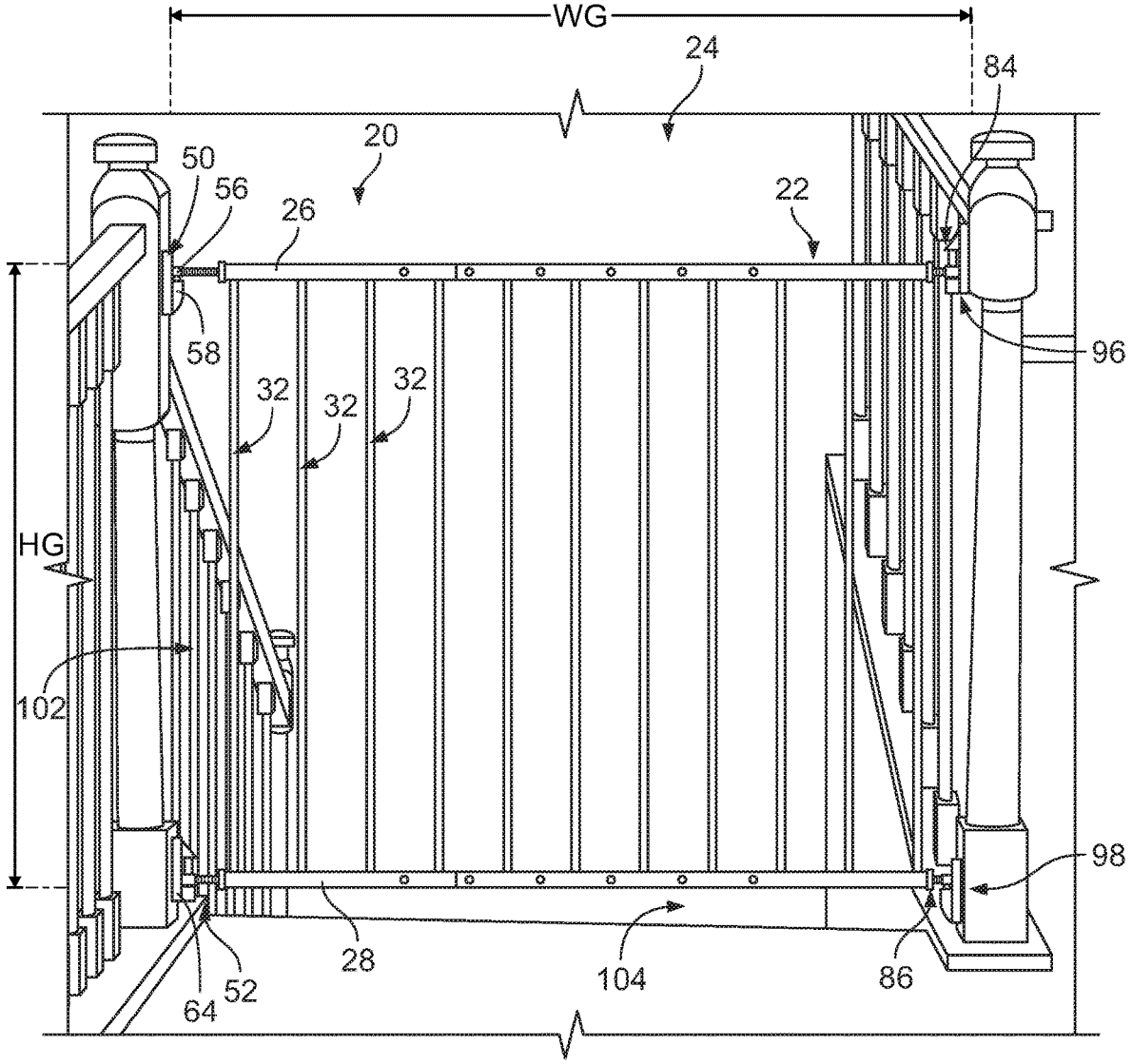
FIG. 3 is a front view of the first and second portions of the baby gate assembly of FIGS. 1 and 2 in an assembled state and installed configuration.

Referring now to the steps of installing the gate assembly 24 as shown in FIGS. 3-11, in a preferred embodiment, the gate assembly 24 is installed in a structurally sound opening. A hinge side 102 of the gate assembly 24 is preferably mounted to a rigid surface, such as a wall or a stairway bannister. As provided in FIG. 3, if using gate assembly within a stairway 104, the gate assembly 24 should be placed at either a top stair, as illustrated in FIG. 3, or at a lowest stair (not shown) at the bottom. An appropriate width may be achieved by adjusting gate sections via fasteners 48 and one or more of the four corner spindles 50, 52, 84, 86. Each of the spindles 50, 52, 84, 86 is capable of adjustment individually, and may be extended to varying lengths to allow for molding, uneven walls, etc.

Figure 5:
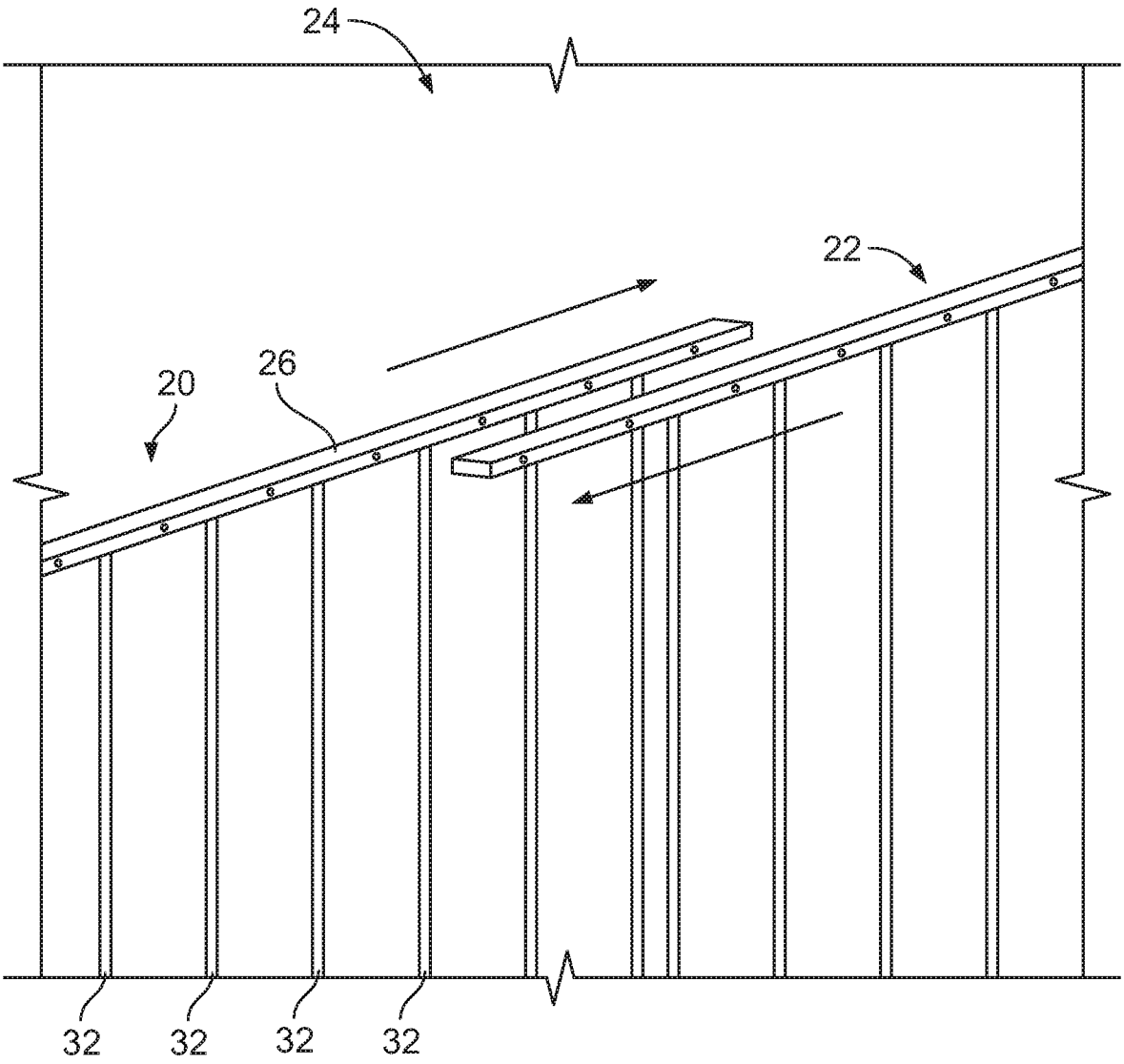
FIG. 5 is a perspective view of the first and second portions of the baby gate assembly of FIG. 3 that illustrates horizontal adjustability of the assembly.
Figure 6:
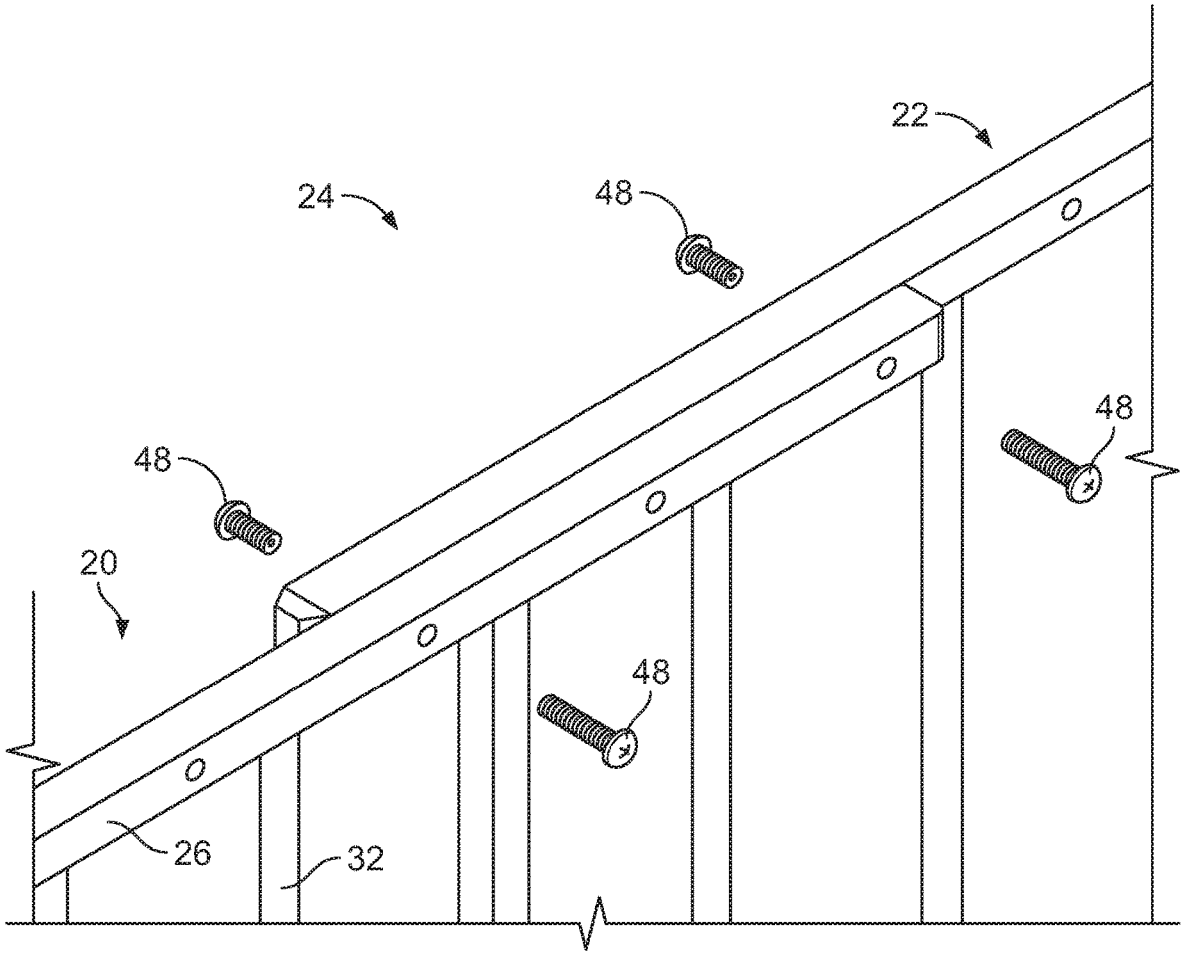
FIG. 6 is a perspective view of the first and second portions of the baby gate assembly of FIG. 3 that illustrates means of fastening the first portion to the second portion.

In particular, referring to FIGS. 4 and 5, once an appropriate width of the gate assembly 24 is determined, the first and second portions 20, 22 can be adjusted until the gate assembly is approximately the correct or an appropriate width. Referring specifically to FIG. 5, the adjustment apertures 46 should be aligned and should overlap in at least two places along both the top rails 26, 70 and the bottom rails 28, 72. Referring now to FIG. 6, the retention fasteners 48, which may be pins, screws with nuts, screw sockets, or other types of fasteners, are placed through the adjustment holes 46, and should be slightly tightened. After installing the retention fasteners 48, and referring to FIG. 7, a threaded portion 110 of the upper spindle assembly 50 should be screwed into the first top rail 26 via an upper spindle bolt 112, and fastened in place using an upper spindle nut 114. Referring to FIG. 8, a threaded portion 116 of the lower spindle assembly 52 should be screwed into the first bottom rail 28 via a lower spindle bolt 118, and fastened in place using a lower spindle nut 120. The spindle assemblies 50, 52, which include the bolts 112, 118 and the nuts 114, 120 should be adjusted until a desired width is achieved, such that the pin 54 of the top spindle assembly 50 can be inserted into the hinge 58.

Referring to FIGS. 7-11, once the upper spindle hinge assembly 50 and the lower spindle hinge assembly 52 have been screwed into the first upper rail 26 and the first lower rail 28, respectively, the spindle assemblies 50, 52 are extended equidistance from the rails 26, 28 to ensure that the baby gate assembly 24 can pivot about an axis defined by the pin 54. Incremental changes in how far the spindles 50, 52 are spaced from the rails 26, 28 can be made at any time by adjusting the nuts 114, 120 and/or the bolts 112, 118 of the spindle assemblies 50, 52. The upper spindle hinge 58 and the lower spindle bracket 64 are mounted via screws 122 or another type of fastener to the doorway or wall, as shown in the figures. As one of ordinary skill may appreciate, the screws 122 preferably are used to mount directly into wood. Longer screws may be necessary for mounting into studs behind drywall. Once the hinge 58 and the bracket 64 are secured to the wall or other static surface, the spindle assemblies 50, 52 can be coupled thereto.

Figure 7:
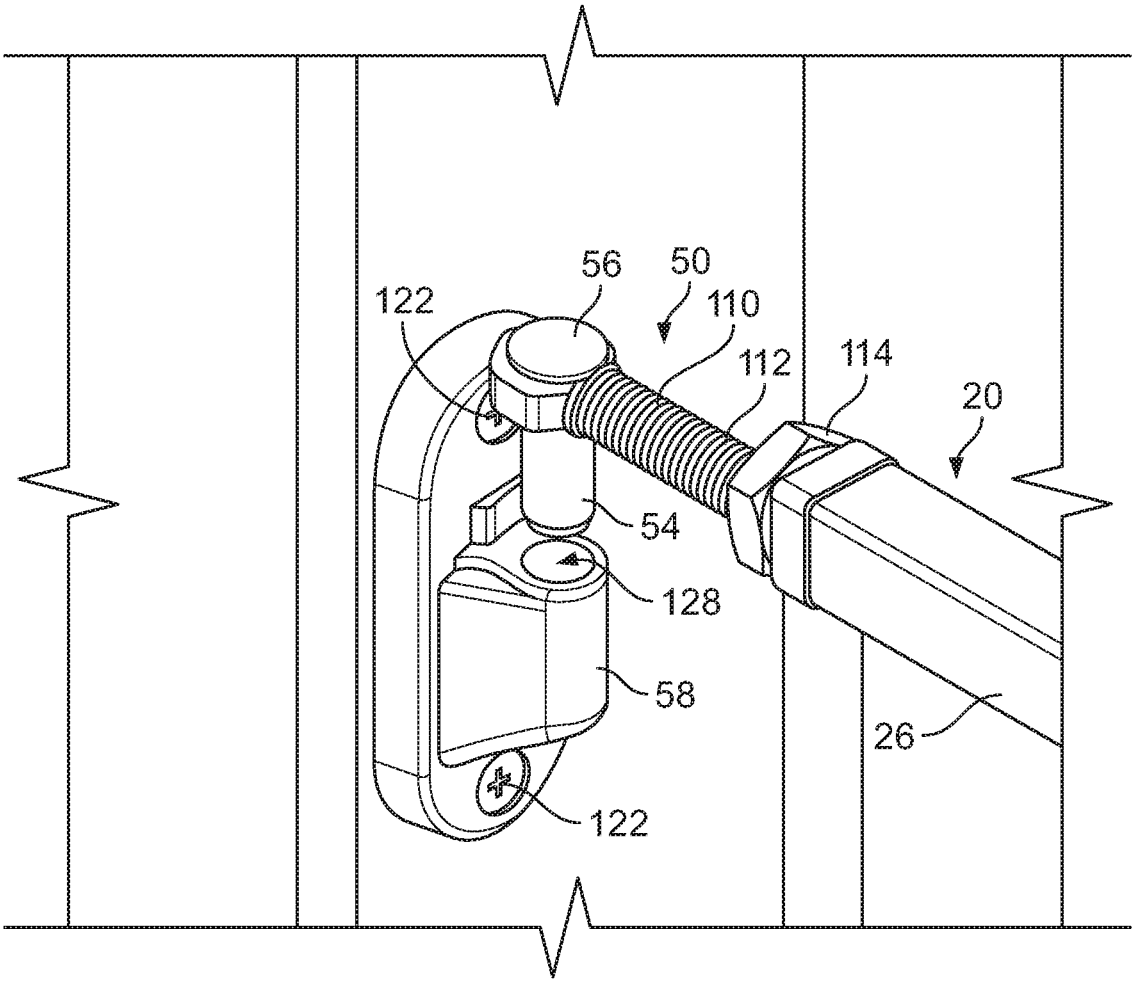
FIG. 7 is a perspective view of an upper hinge spindle of the baby gate assembly of FIG. 3 before insertion into an upper hinge bracket.
Figure 8:
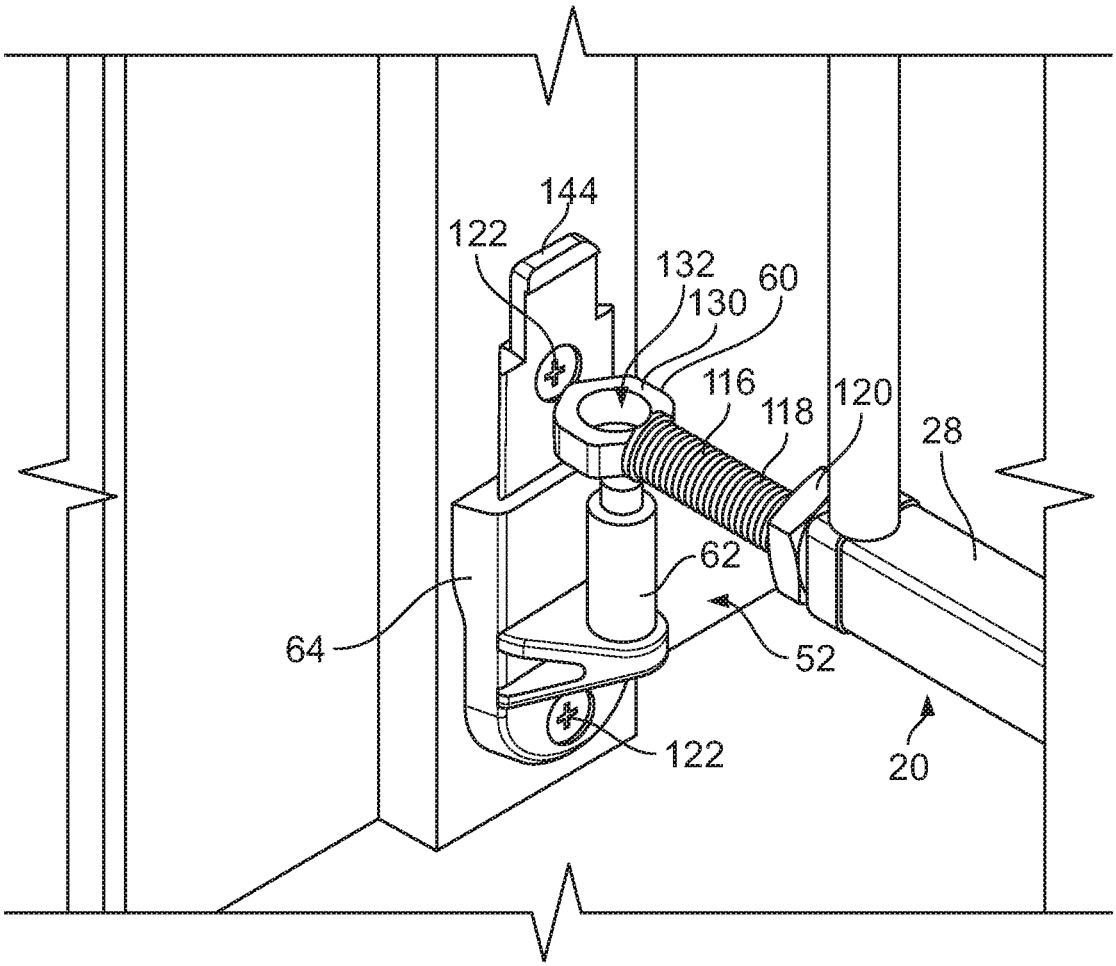
FIG. 8 is a perspective view of a lower hinge spindle assembly of the baby gate assembly of FIG. 3 being placed along a lower hinge post.
Figure 10:
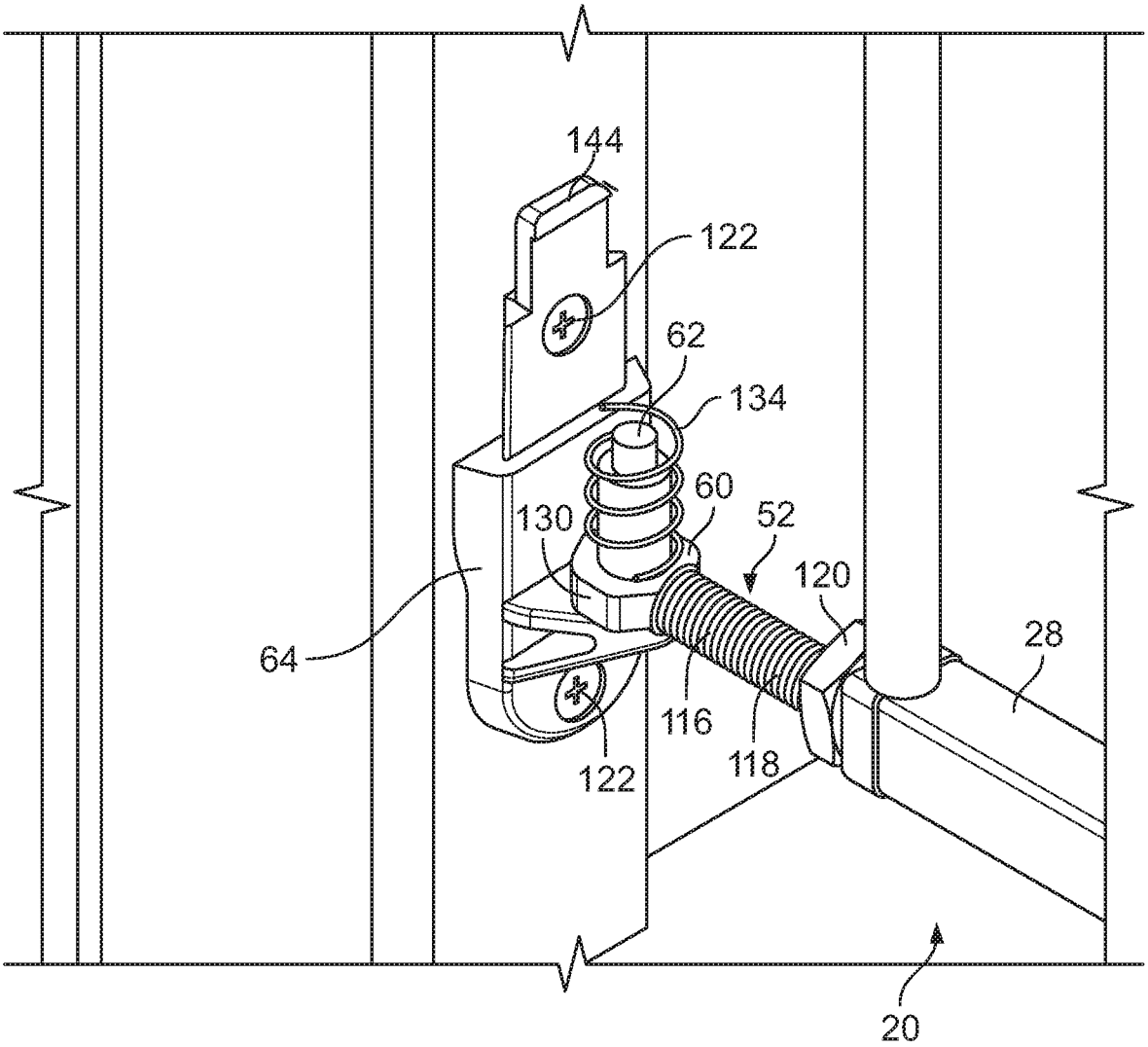
FIG. 10 is a perspective view of the lower hinge spindle assembly of FIG. 8 with a spring placed along the lower hinge post.
Figure 11:
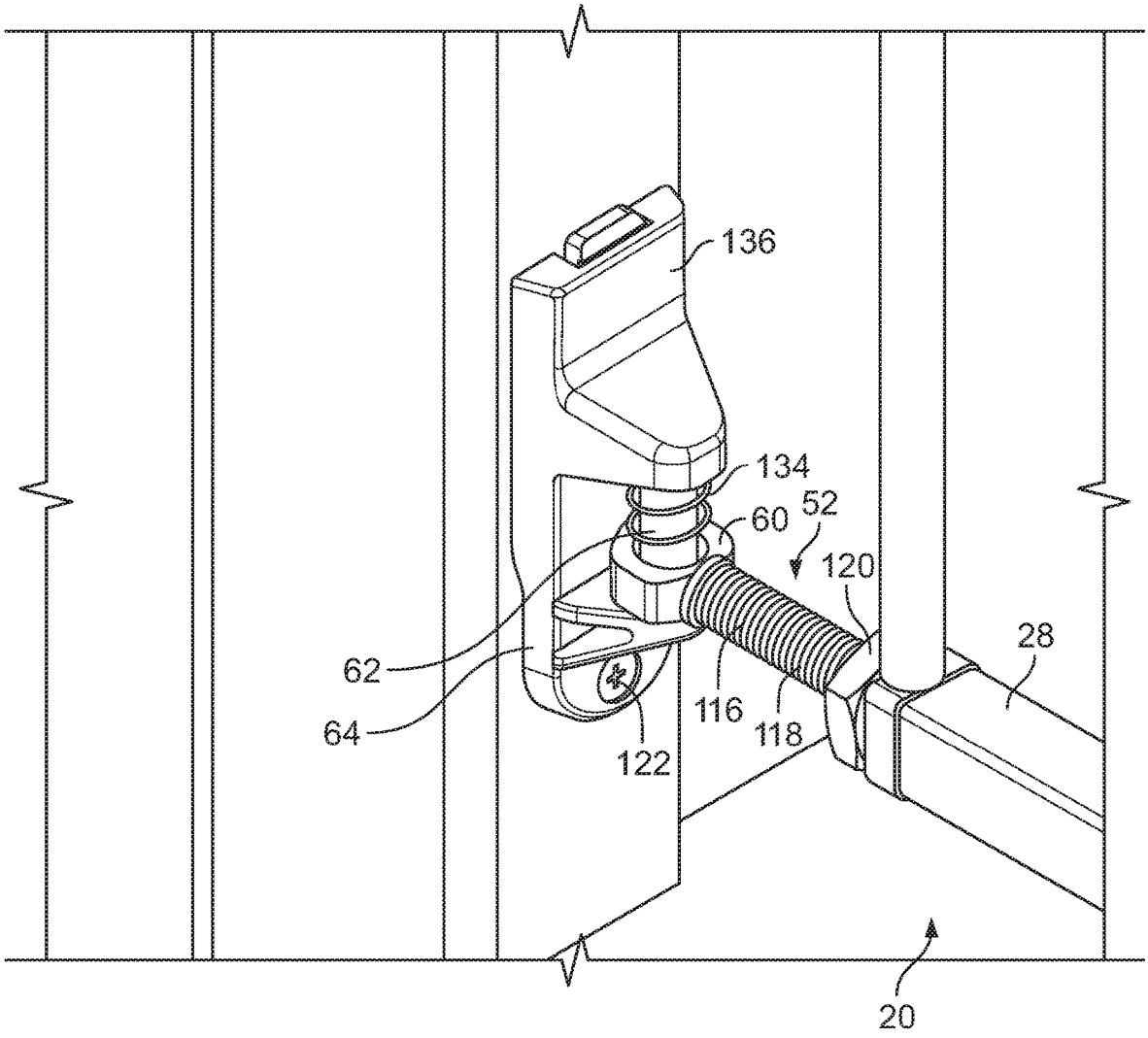
FIG. 11 is a perspective view of the lower hinge spindle assembly of FIG. 8 with a lower hinge cap being placed on the lower hinge.

Referring to FIG. 7, the upper hinge spindle 50 includes the pin 54 that extends downward and is received by a hinge cavity 128 within the upper hinge 58. The upper hinge spindle 50 may simply rest within the hinge cavity 128, and may be rotatable therein. In some embodiments, a lubricant, such as grease or silicone, may be used to decrease friction as the upper hinge spindle 50 moves within the hinge cavity 128. Referring to FIG. 8, the lower hinge spindle assembly 52 includes an end nut 130 which is inserted over the wall post 62 that is a component of the lower hinge bracket 64. The hinge post 62 extends upward, and has a diameter that is generally the same as a diameter of an interior aperture 132 of the end nut 130. The end nut 130 is therefore rotatable along the hinge post 62. As illustrated in FIGS. 10 and 11, once the end nut 130 is provided over the hinge post 62, a spring 134 is inserted thereover. Referring specifically to FIG. 11, a hinge cap 136 is snapped onto the lower hinge bracket 64, and retains the spring 134 in position. Once the hinge cap 136 is secured to the lower hinge bracket 64, the spring 134 applies a continual downward force against the end nut 130, which maintains the baby gate assembly 24 vertically in place during rotation and when closed.

Referring to FIG. 9, a representative image of an upper locking latch bracket 140 is shown. The upper locking latch bracket 140 is positioned appropriately along the wall to align with the upper spindle latch assembly 84. The upper locking latch bracket 140 includes a locking mechanism 142, which can be pressed downward, in a direction of arrow A, to unlatch the spindle assembly 84. A lower locking latch bracket (not shown), is similarly positioned along the wall and is secured in place to receive the lower spindle assembly 86. Once the upper locking latch bracket 140 and the lower locking latch bracket are in place, the gate assembly 24 is in an operable configuration. To open the gate, a user presses down on locking latch with thumb and lifts the gate out of upper and lower brackets, permitting the gate to pivot about the pin 54 and wall post 62. To lock the gate, top locking latch spindle must lock under locking latch and bottom latch spindle must rest in bottom bracket as shown. In order to remove the gate completely, the user may press back on a locking tab 144 on top of the lower hinge bracket 64 while sliding the hinge cap 136 up. Once the hinge cap 136 is removed, the user may remove the spring 134 and lift the gate off of the top and bottom hinges.

Figure 12:
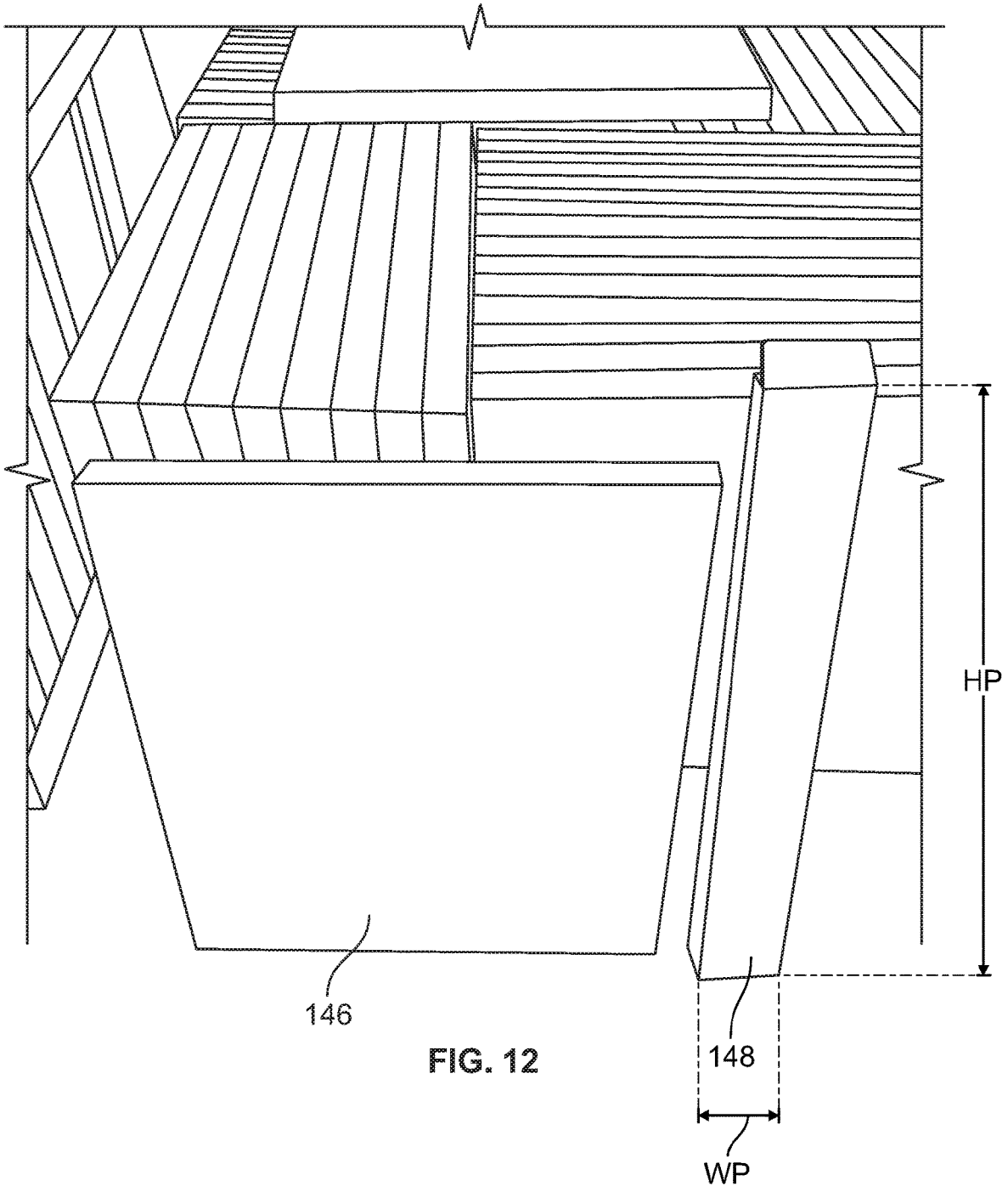
FIG. 12 is a front view of a comparative image illustrating a prior art shipping container and a shipping container according to the kit of the present disclosure.
Figure 13:
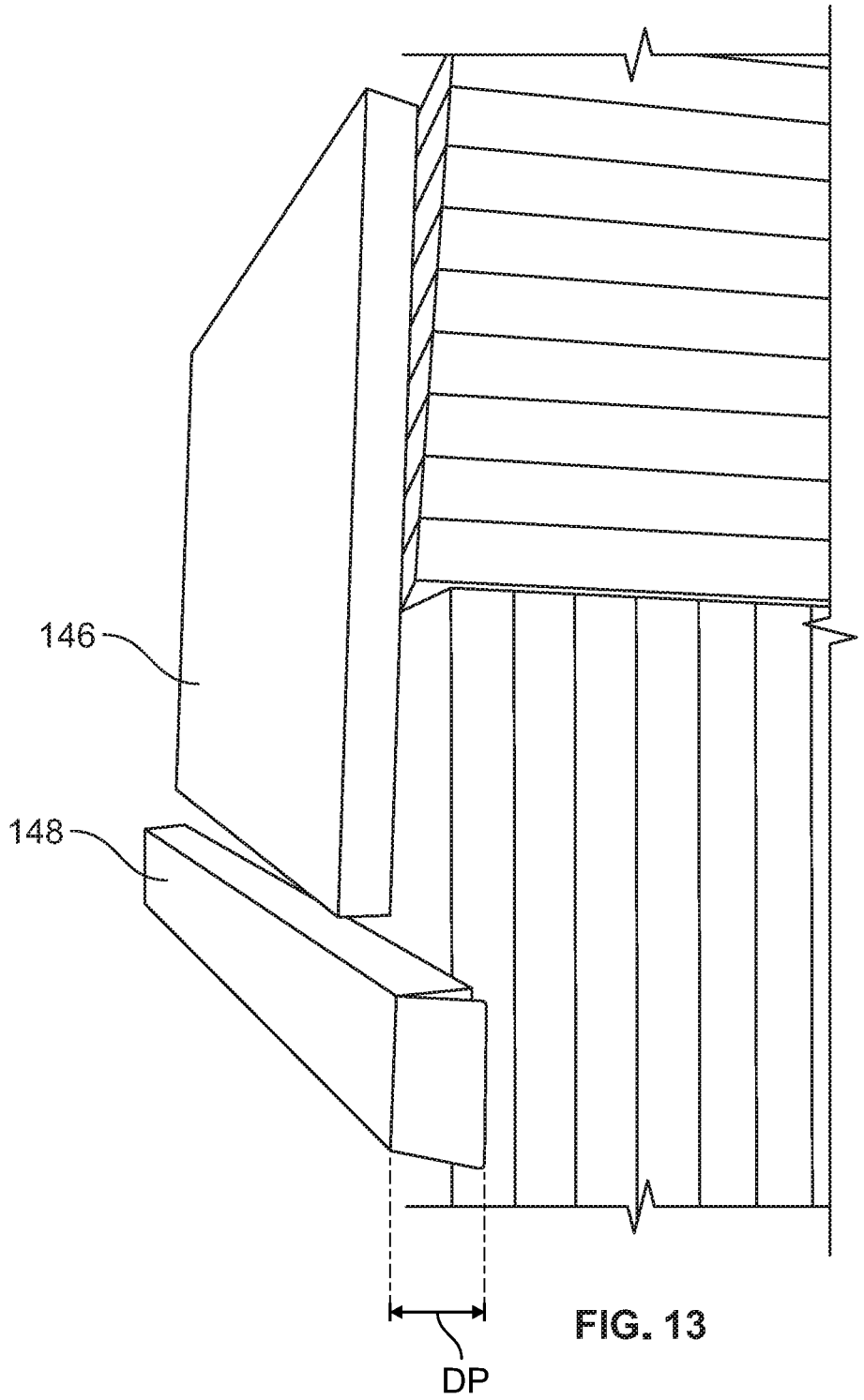
FIG. 13 is a top view of the comparative image of FIG. 12 illustrating the prior art shipping container and the shipping container according to the kit of the present disclosure.

Referring to FIGS. 12 and 13, traditional gates are welded together and shipped in large boxes, such as the old packaging 146, with fully assembled panels therein. By volume, the contents of such packages are primarily empty space, i.e., the area between posts.

It surprisingly was found that the new packaging 148 significantly improves issues associated with transit, including space constraints and shipping costs, as well as issues surrounding the use of valuable shelf space at the retail level. The traditional or old package 144 has dimensions that are approximately 22"×25"×1.5" (55.8 cm×63.5 cm×3.8 cm). The new packaging 148 of the concept disclosed herein has dimensions of approximately 2"×28.5"×3.5" (5.08 cm×72.39 cm×8.89 cm). Thus, for every four gates packed in old packaging 146, approximately eighteen disassembled gates may be packed in new packaging 148 and take up approximately the same volume in a shipping container, on a store shelf, etc. Additionally, it was found that shipping costs for both the old packaging 146 and new packaging 148 may be based on a formula involving a volumetric calculation component, whereby the reduced volume of the new packaging 148 may reduce that volumetric calculation component by approximately an order of magnitude, significantly reducing per unit shipping costs.

Still referring to FIGS. 12 and 13, the new packaging 148 defines a width of the packaging WP (see FIG. 12), a height of the packaging HP (see FIG. 12), and a depth of the packaging DP (see FIG. 13). Referring to FIGS. 3 and 4, the gate 24, when fully assembled, defines a width of the gate WG (see FIG. 3), a height of the gate HG (see FIG. 3), and a depth of the gate DG (see FIG. 4). Still further, referring to FIG. 1, the first panel defines a width of the first panel WF, a height of the first panel HF, and a depth of the first panel DF (see FIG. 4).

The width of the packaging WP may be a first packaging dimension, the height of the packaging HP may be a second packaging dimension, and the depth of the packaging DP may be a third packaging dimension. The width of the first panel WF may be a first panel dimension, the height of the first panel HF may be a second panel dimension, and the depth of the first panel DF may be a third panel dimension. The width of the gate WG may be a first gate dimension, the height of the gate HG may be a second gate dimension, and the depth of the gate DG may be a third gate dimension. In some embodiments, the first packaging dimension is less than the respective first gate dimension, as shown in the Figures. The first, second, and third dimensions of the packaging, panel, and/or gate may be rearranged, and need not be limited to the specific structure recited above.

In some embodiments, the new packaging 148 has at least one dimension, i.e., the width WP, the height of the packaging HP, or the depth of the packaging DP, that is less than at least one respective dimension of the gate 24, i.e., the width of the gate WG, the height of the gate HG, or the depth of the gate DG. In some embodiments, the width of the packaging WP is between about 5% and about 70% of the width of the gate WG, or between about 10% and about 60% of the width of the gate WG, or between about 15% and about 50% of the width of the gate WG. In some embodiments, the width of the packaging WP is less than about 70% of the width of the gate WG, or less than about 60% of the width of the gate WG, or less than about 50% of the width of the gate WG, or less than about 40% of the width of the gate WG, or less than about 30% of the width of the gate WG, or less than about 20% of the width of the gate WG, or less than about 10% of the width of the gate WG. While the widths, heights, and depths of the new packaging 148 and the gate 24 are specifically referred to in the figures, the dimensions may be re-organized, such that the width, height, and/or depth comprise different dimensions than those shown in the Figures.

Still further, in some embodiments, the new packaging 148 has at least one dimension, i.e., the width WP, the height of the packaging HP, or the depth of the packaging DP, that is less than at least one respective dimension of the first panel 20, i.e., the width of the first panel WF, the height of the first panel HF, or the depth of the first panel DF. In some embodiments, the width of the packaging WP is between about 5% and about 70% of the width of the first panel WF, or between about 10% and about 60% of the width of the first panel WF, or between about 15% and about 50% of the width of the first panel WF. In some embodiments, the width of the packaging WP is less than about 70% of the width of the first panel WF, or less than about 60% of the width of the first panel WF, or less than about 50% of the width of the first panel WF, or less than about 40% of the width of the first panel WF, or less than about 30% of the width of the first panel WF, or less than about 20% of the width of the first panel WF, or less than about 10% of the width of the first panel WF. While the widths, heights, and depths of the new packaging 148 and the first panel 20 are specifically referred to in the figures, the dimensions may be re-organized, such that the width, height, and/or depth comprise different dimensions than those shown in the Figures.

By designing a kit including the various disassembled components described herein and the new packaging 148 for retaining those components, a gate assembly that can be set up on site quickly and with relatively simple assembly, with a reduced shipping and storage profile, and with reduced shipping costs is provided.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the present disclosure and claims. The entire disclosure of each patent and publication cited herein is incorporated by reference, as if each such patent or publication were individually incorporated by reference herein.

We claim:

1. A kit for a baby gate assembly, comprising:

a first panel that includes a first upper rail, a first lower rail, and a plurality of first posts;

a second panel that includes a second upper rail, a second lower rail, and a plurality of second posts;

a plurality of spindle assemblies; and a plurality of latch assemblies, wherein the first panel defines a plurality of panel dimensions, wherein components comprising the first panel, the second panel, the plurality of spindle assemblies, and the plurality of latch assemblies are contained in a package that defines a plurality of packaging dimensions, and wherein at least two of the plurality of packaging dimensions are smaller than at least two of the corresponding panel dimensions, wherein the plurality of spindle assemblies includes an upper spindle assembly and a lower spindle assembly that is different than the upper spindle assembly, and wherein the upper spindle assembly includes a post that depends from a spindle, and the lower spindle assembly includes an end nut that is capable of being inserted over a wall post.

2. The kit for a baby gate assembly of claim 1, wherein the plurality of first posts includes at least one first cylindrical post, at least one first fastening post, and at least one first crimped post.

3. The kit for a baby gate assembly of claim 2, wherein the plurality of second posts includes at least one second cylindrical post, at least one second fastening post, and at least one second crimped post.

4. The kit for a baby gate assembly of claim 2, wherein the at least one first fastening post is capable of being securely fastened to the first upper rail, while the at least one first cylindrical post is capable of being inserted into a post receiving aperture of the first upper rail.

5. The kit for a baby gate assembly of claim 1, wherein the first upper rail and the second upper rail each include a plurality of adjustment apertures that are capable of alignment with one another.

6. The kit for a baby gate assembly of claim 1, wherein the first upper rail, the first lower rail, the second upper rail, and the second lower rail each include a plurality of post receiving apertures.

7. The kit for a baby gate assembly of claim 6, wherein the plurality of post receiving apertures along each of the first upper rail, the first lower rail, the second upper rail, and the second lower rail have varying diameters.

8. The kit for a baby gate assembly of claim 1, wherein the plurality of spindle assemblies each include a bolt and a nut, the bolt being capable of insertion into the first upper rail and the first lower rail.

9. A method of shipping and assembling a baby gate assembly, comprising the steps of:

providing a package that has a profile that has a first packaging dimension, a second packaging dimension, and a third packaging dimension; and inserting into the package a plurality of components that include a first panel that includes a first upper rail, a first lower rail, and a plurality of first posts, a second panel that includes a second upper rail, a second lower rail, and a plurality of second posts, a plurality of spindle assemblies, and a plurality of latch assemblies, wherein the first panel, when assembled, defines a first panel dimension, a second panel dimension, and a third panel dimension, wherein at least two of the first packaging dimension, the second packaging dimension, and the third packaging dimension are smaller than at least two of the first panel dimension, the second panel dimension, and the third panel dimension, wherein the plurality of spindle assemblies includes an upper spindle assembly and a lower spindle assembly that is different than the upper spindle assembly, and wherein the upper spindle assembly includes a post that depends from a spindle, and the lower spindle assembly includes an end nut that is capable of being inserted over a wall post.

10. The method of shipping and assembling the baby gate assembly of claim 9 further comprising the step of aligning the first panel with the second panel and inserting at least one fastener through adjustment apertures within the first upper rail and the second upper rail.

11. The method of shipping and assembling the baby gate assembly of claim 10 further comprising the steps of inserting the upper spindle assembly into the first upper rail, and inserting the lower spindle assembly into the first lower rail.

12. The method of shipping and assembling the baby gate assembly of claim 9, wherein the plurality of second posts includes at least one second cylindrical post, at least one second fastening post, and at least one second crimped post.

13. The method of shipping and assembling the baby gate assembly of claim 12, wherein the plurality of first posts includes at least one first cylindrical post, at least one first fastening post, and at least one first crimped post, and wherein the at least one first fastening post is capable of being securely fastened to the first upper rail, while the at least one first cylindrical post is capable of being inserted into a post receiving aperture of the first upper rail.

14. The method of shipping and assembling the baby gate assembly of claim 9, wherein the first upper rail and the second upper rail each include a plurality of adjustment apertures that are capable of alignment with one another, and the method further includes the step of aligning the plurality of adjustment apertures along the first upper rail and the plurality of adjustment apertures along the second upper rail.

15. The method of shipping and assembling the baby gate assembly of claim 9, wherein the first upper rail, the first lower rail, the second upper rail, and the second lower rail each include a plurality of post receiving apertures.

16. The method of shipping and assembling the baby gate assembly of claim 15 further comprising the steps of inserting at least some of the first posts into the plurality of post receiving apertures along the first upper rail or the first lower rail, and inserting at least some of the second posts into the plurality of post receiving apertures along the second upper rail or the second lower rail.

17. The method of shipping and assembling the baby gate assembly of claim 9, wherein the plurality of spindle assemblies each include a bolt and a nut, the bolt being capable of insertion into the first upper rail and the first lower rail.

* * * * *